US006157794A

United States Patent [19]

Katsumi et al.

[11] Patent Number: 6,157,794

[45] Date of Patent: Dec. 5, 2000

[54] SYSTEM TO REDUCE MIXING OF TONER AND MAGNETIC CARRIER

[75] Inventors: Toru Katsumi; Takao Honda, both of Mishima, Japan

[73] Assignee: Canon Kabushiki Kaisha, Tokyo, Japan

[21] Appl. No.: 08/974,729

[22] Filed: Nov. 19, 1997

[30] Foreign Application Priority Data

Nov. 19, 1996 [JP] Japan ..... 8-323554

[51] Int. Cl.[7] ..... G03G 15/06; G03G 15/08

[52] U.S. Cl. ..... 399/53; 399/55; 399/228

[58] Field of Search ..... 399/18, 21, 31, 399/50, 53, 55, 223, 228, 229, 230, 234

[56] References Cited

U.S. PATENT DOCUMENTS

| | | | |
|---|---|---|---|
| 4,937,630 | 6/1990 | Yoshikawa et al. | 355/273 |
| 5,003,353 | 3/1991 | Nitta | 355/265 |
| 5,373,351 | 12/1994 | Umeda et al. | 355/208 |
| 5,481,337 | 1/1996 | Tsuchiya et al. | 347/208 |
| 5,610,689 | 3/1997 | Kamiya et al. | 399/31 |
| 5,671,468 | 9/1997 | Yamamoto et al. | 399/169 |

FOREIGN PATENT DOCUMENTS 1-009480 1/1989 Japan .

*Primary Examiner*—Matthew S. Smith
*Assistant Examiner*—Hoang Ngo
*Attorney, Agent, or Firm*—Fitzpatrick, Cella, Harper & Scinto

[57] ABSTRACT

There is related to an image forming apparatus for forming a two-color toner image on a photosensitive body and transferring a batch of the image to a transfer material. The apparatus has a rotating and moving electrophotographic photosensitive body. Successively along a rotating direction of the photosensitive body arranged are a first developing device using a two-component developing agent constituted of a magnetic carrier and a nonmagnetic toner and a second developing device using a one-component magnetic developing agent different in color from the nonmagnetic toner. The apparatus also has a control circuit for stopping an image forming operation when a trouble occurs in an apparatus body. To prevent the carrier of the first developing device from mixing in the second developing device, a drive mechanism is provided for detaching a magnet of the second developing device from the photosensitive body to a position at which the carrier adhering from the first developing device to the photosensitive body does not mix in the second developing device by means of a magnetic force of the second developing device when the image forming operation is stopped.

7 Claims, 9 Drawing Sheets

SYSTEM TO REDUCE MIXING OF TONER AND MAGNETIC CARRIER

BACKGROUND OF THE INVENTION

1. Field of the Invention

The present invention relates to a multicolor image forming apparatus which forms a color-overlapped image on a photosensitive body with toners different in color in an electrophotographic method and which transfers the image on a transfer material once. It especially relates to a copying machine, a printer or another two-color image forming apparatus which uses two-color toner to obtain a two-color image.

2. Related Background Art

In such a multicolor image forming apparatus, a surface of a rotating electrophotographic photosensitive body is uniformly charged with a charging means and thereafter exposed to a laser beam or the like in accordance with a predetermined image signal to form an electrostatic latent image thereon. Then, by applying a predetermined bias to a developing means, toner is adhered to an exposed portion of the latent image to develop an image. By repeating this plural times, an overlapped toner image of plural colors is formed, transferred in a batch once to a sheet of transfer material and fixed thereon to obtain a multicolor permanent image.

A portion of a periphery of a photosensitive body in a two-color image forming apparatus is shown in FIG. 10. The two-color image forming apparatus is provided along a rotating direction of a photosensitive body 1 with two developing means, i.e. a first developing unit 4 and a second developing unit 7. The first developing unit 4 includes a two-component developing agent constituted of a toner T1 and a magnetic carrier C. On a developing roller 41 with a magnetic roller 42 built therein, the toner T1 and the carrier C are held. The held two-component developing agent is applied by a regulating member 43 onto the developing roller 41 and conveyed to a development region in which the photosensitive body 1 is opposed to the developing roller 41. In the development region, by applying a predetermined bias to the developing roller 41, the toner is adhered to a first latent image on the photosensitive body 1 to develop and visualize a first toner image.

The second developing unit 7 includes a magnetic toner T2 which is different in color from the toner T1 in the first developing unit 4. On a developing roller 71 with a magnetic roller 72 built therein, the toner T2 is held. The held toner T2 is applied by a regulating member 73 onto the developing roller 71 and conveyed to the development region. In the development region, by applying a predetermined bias to the developing roller 71, the toner is adhered to a second latent image on the photosensitive body 1 with the first toner image formed thereon, to develop and visualize a second toner image.

In this manner, while the photosensitive body 1 rotates once, a two-color overlapped toner image is formed on the photosensitive body 1. The toner image is transferred to a transfer material once and thereafter fixed to obtain a two-color permanent image.

Usually in the aforementioned image forming apparatus, if during image formation a jam of a transfer sheet, an error of a sheet supply system or another trouble occurs, by checking its error signal, a drive motor of the photosensitive body is stopped. Also, a primary charge output, a laser exposure and an application of a bias to the developing units are cut off, thereby stopping an image forming process.

However, even when an application of a driving voltage to the drive motor of the photosensitive body is stopped, the photosensitive body 1 rotates due to an inertial force produced by its weight. Until the photosensitive body completely stops rotating, a uniformly charged region extending from a primary charging means position to a laser exposure position on the photosensitive body 1 passes the first developing unit 4. When the bias to the developing roller 41 is cut off at the same time the trouble occurs, then between the developing unit 4 and the charged region of the photosensitive body 1, an electric field is produced to attract the carrier C in the developing agent toward the photosensitive body 1. Therefore, the carrier C adheres to the photosensitive body 1.

The carrier C adhering to the photosensitive body 1 is conveyed to a vicinity of the development region of the second developing unit 7 while the photosensitive body 1 is rotating. Since the developing roller 71 of the second developing unit 7 contains the magnetic roller 72, a portion of the conveyed carrier C adheres to the developing roller 71 because of a magnetic suction force and is taken into the developing unit 7. The taken carrier C accumulates in a vicinity of an opposed portion of the developing roller 71 and the regulating member 73, thereby inhibiting application of the toner T2. Therefore, an uneven application, a resulting uneven concentration of the second toner image or another image deterioration is caused. The adhesion of the carrier to the photosensitive body and the mixture thereof into the second developing unit at the time of occurrence of jam or another trouble are detailed in the description of embodiments of the invention.

As a countermeasure to solve the problem, Japanese Patent Publication No. 7-50350 proposes a method in which to prevent the adhesion of a carrier at the time of trouble occurrence, a potential of a photosensitive body before passing a developing means is detected by a potential sensor and a bias of the developing means is controlled in accordance with a change in potential of the photosensitive body. However, in the two-color image forming apparatus, since two developing means are disposed around the photosensitive body, in some case no space can be secured for mounting the potential sensor. Also, if the potential sensor is soiled by toner floating in the device, a precise control cannot be performed, thereby causing the adhesion of the carrier.

SUMMARY OF THE INVENTION

An object of the present invention is to provide a two-color image forming apparatus which prevents a magnetic carrier adhered to a photosensitive body from mixing in a second developing means when a jam of a transfer material or another trouble occurs while an image is formed by forming a two-color toner image during one rotation of the photosensitive body and transferring a batch of the toner image to the transfer material and which can obtain a good two-color image without an uneven concentration of a second toner image or another defect.

To attain this and other objects, the invention provides an image forming apparatus for forming a two-color toner image on a photosensitive body and transferring a batch of the image to a transfer material. The image forming apparatus is provided with a rotating and moving electrophotographic photosensitive body. Successively along a rotating direction of the photosensitive body arranged are a first charging means, a developing means using a first two-component developing agent constituted of a magnetic carrier and a nonmagnetic toner, a second charging means, a second developing means using a one-component magnetic developing agent different in color from the nonmagnetic toner and a transfer means for transferring to a transfer member a batch of the toner image formed on the photosensitive body by the two-color developing agents.

Further, the image forming apparatus has a stopping means for stopping an image forming operation when a trouble occurs in a device body and a magnetic member moving means for detaching a magnetic member of the second developing means from the photosensitive body to a position at which the carrier adhering from the first developing means to the photosensitive body does not mix in the second developing means by means of a magnetic force of the second developing means when the image forming operation is stopped by the stopping means.

DETAILED DESCRIPTION OF THE PREFERRED EMBODIMENTS

Embodiments of the invention are described with reference to the accompanying drawings.

FIRST EMBODIMENT

Figure 1:
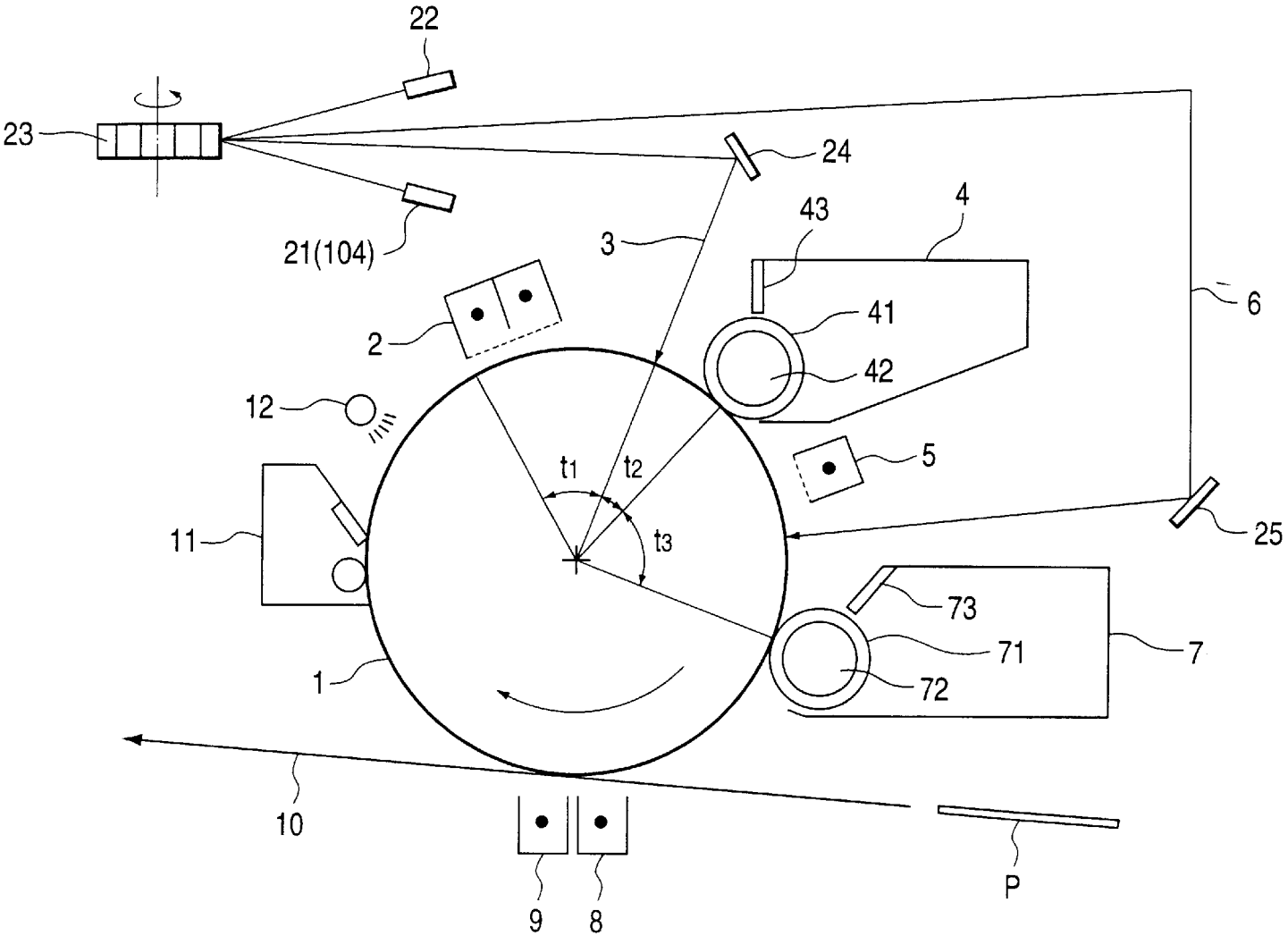
FIG. 1 is a schematic representation entirely showing a two-color image forming apparatus according to an embodiment of the invention.
Figure 10:
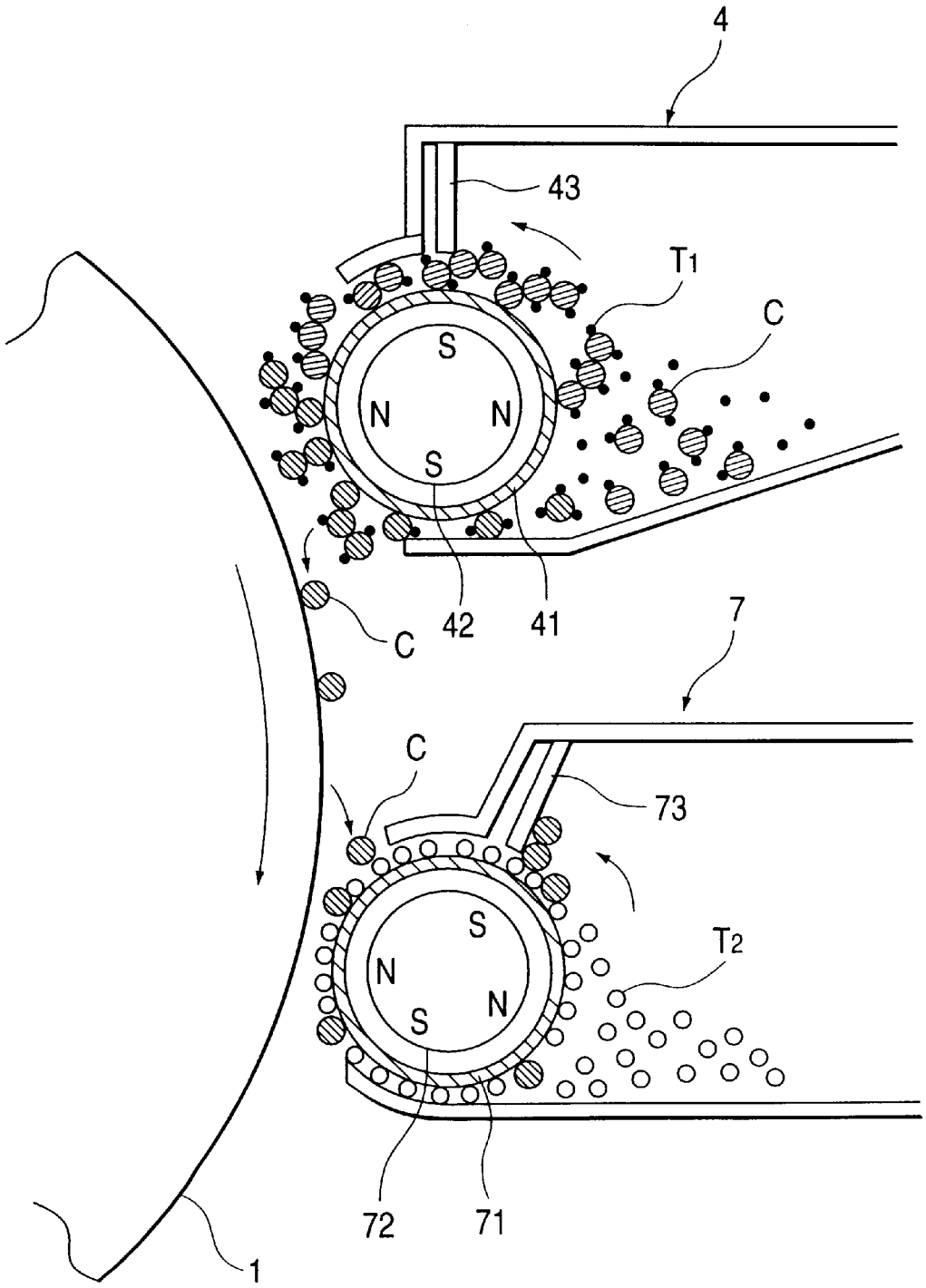
FIG. 10 is a detailed view showing first and second developing units in a prior-art two-color image forming apparatus.

FIG. 1 is a block diagram schematically showing an entire constitution of a two-color image forming apparatus according to an embodiment of the invention. Around a photosensitive body 1 provided with a photoconductive layer mounted on a conductive drum body, along its rotating direction, a scorotron charge unit 2, a first exposure means, a first developing unit 4, a scorotron charge unit 5, a second exposure means, a second developing unit 7, a transfer corona charge unit 8, a separating corona charge unit 9, a cleaning device 11 and an electric eliminating lamp 12 are disposed. The first exposure means is constituted of a semiconductor laser 21, a polygonal mirror 23, a reflective mirror 24 and the like. The second exposure means is constituted of a semiconductor laser 22, the polygonal mirror 23, a reflective mirror 25 and the like. The first and second developing units 4 and 7 are constituted as shown in FIG. 10. In FIG. 1, the same reference numerals as those shown in FIG. 10 denote the same members.

After the photosensitive body 1 is uniformly charged to a predetermined potential level by the scorotron charge unit 2 while rotating in a direction shown by an arrow in the figure, a first exposure 3 is performed by the first exposure means with a laser beam which is modulated in response to a first image signal, to form a first electrostatic latent image. Subsequently, the first electrostatic latent image is developed by the first developing unit 4 by using a two-component constituted of a first-color non-magnetic toner and a magnetic carrier while a developing bias is applied, to form a first toner image of a first color on the photosensitive body 1. In the embodiment the magnetic carrier has an average particle diameter of 50 $\mu$m, an average saturation magnetization of 63 emu/g, an average specific gravity of 4.8 g/cm$^3$.

Subsequently, the photosensitive body 1 with the first toner image formed thereon is again charged uniformly to a predetermined potential level by the scorotron charge unit 5, a second exposure 5 is performed by the second exposure means with a laser beam which is modulated in response to a second image signal, to form a second electrostatic image. The second electrostatic latent image is developed by the second developing unit 7 using a second-color magnetic toner under a developing bias, to form a second toner image of a second color overlapping the first toner image of the first color on the photosensitive body 1. Since a second-color development is performed in a non-contact system in which the magnetic toner held on a toner holding body (the developing roller 71 of FIG. 10) of the second developing unit 7 does not contact the photosensitive body 1, a second-color development can be performed without disturbing the first-color toner image.

A two-color overlapped toner image formed in this manner is transferred using the transfer corona charge unit 8 on a transfer sheet P which is supplied along a conveyance path 10 to the photosensitive body 1. The transfer sheet P is then peeled from the photosensitive body 1 by the separating corona charge unit 9 to be fed to a fixing device (not shown). The overlapped image is thus permanently fixed on the transfer sheet, to form a two-color image. Completing the transfer process, the photosensitive body 1 continuously rotates. Subsequently, residual toner is removed from a surface of the photosensitive body 1 by the cleaning device 11, and residual charge is eliminated from the surface of the photosensitive body 1 by the electric eliminating lamp 12. A subsequent image formation is repeated.

Figure 2:
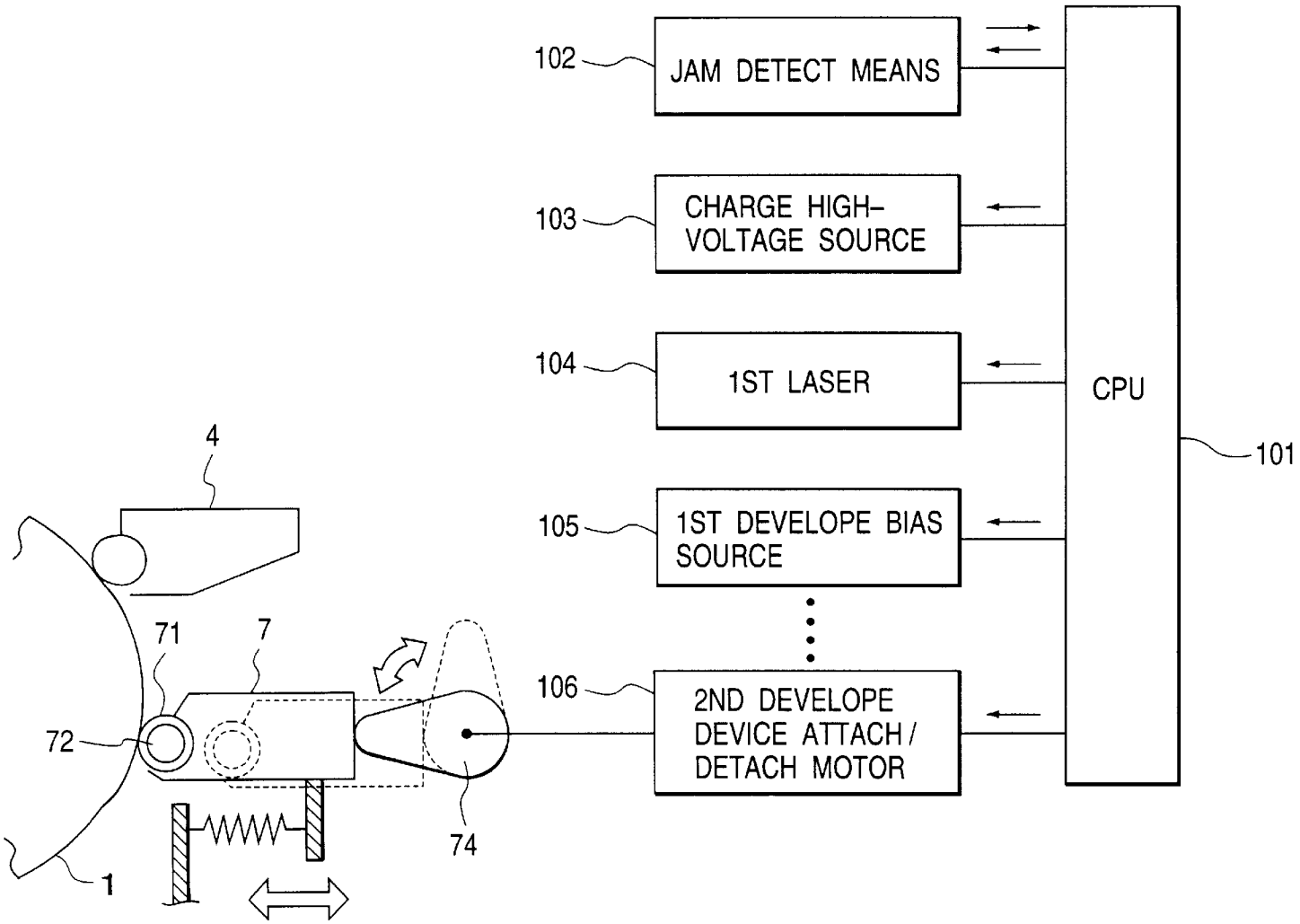
FIG. 2 is a block diagram of a device mounted on the image forming apparatus of FIG. 1 for preventing a magnetic carrier from adhering and mixing in at the time of occurrence of a trouble.

According to the invention, when the jam of the transfer material and other troubles occur, to prevent the magnetic carrier of the first developing unit 4 from adhering to the photosensitive body 1 and mixing in the second developing unit 7, as shown in FIG. 2, the second developing unit 7 can be detached from the photosensitive body 1.

FIG. 2 is a block diagram of a device for preventing the adhesion and mixture of the magnetic carrier at the time of trouble occurrence in the invention. To a microcomputer 101 mounted in the image forming apparatus connected are a jam detecting means 102, a high-voltage source 103 of the first charge unit 2, a first laser 104, a first developing bias source 105 and a second developing device attaching/detaching motor 106. A moving means of the second developing unit 7 is constituted by combining the attaching/detaching motor 106 with a developer pressure cam 74. The second developing unit 7 can be moved close to and apart from the photosensitive body 1 by rotating the developer pressure cam 74 linked to the attaching/detaching motor 106. When the jam occurrence is detected by the jam detecting means 102, a signal is transmitted to the microcomputer 101, which in turn transmits a drive signal to the charge high-voltage source 103, the first laser 104, the first developing bias source 105, the attaching/detaching motor 106 and other image forming means. A flow of operation after the jam occurrence is performed in accordance with a predetermined drive timing described later. The other image forming means (not shown in FIG. 2) are similarly driven in accordance with the signal from the microcomputer 101.

Prior to a description of a method for preventing the adhesion and mixture of the carrier at the time of occurrence of jam or another trouble in the invention, the mixture of carrier in a prior-art two-color image forming apparatus is described with reference to FIGS. 11 and 12.

Figure 11:
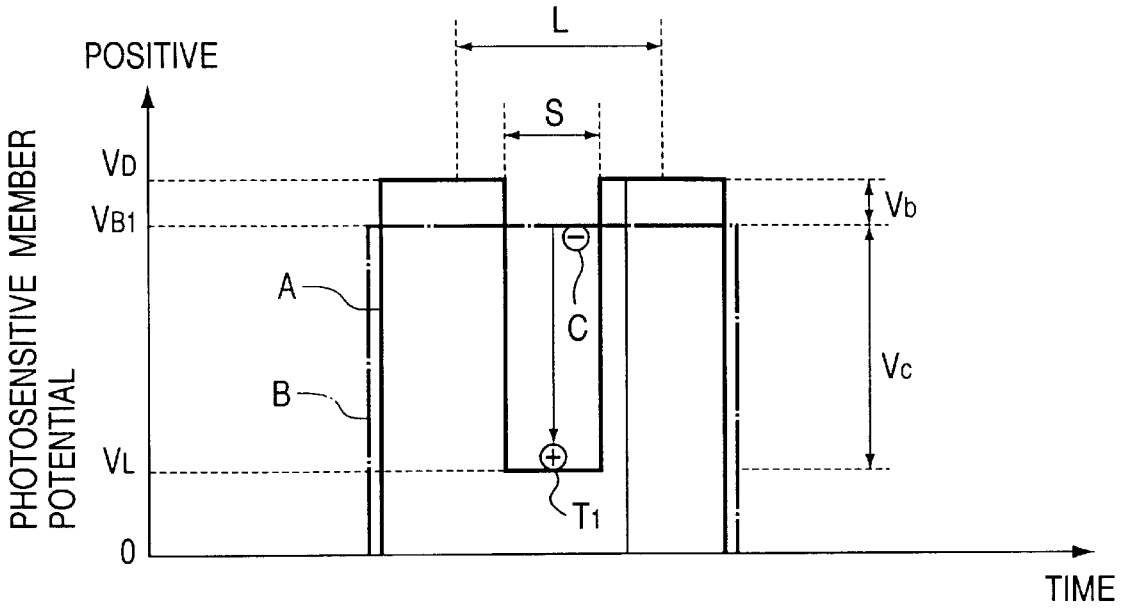
FIG. 11 shows changes in potential and developing bias during image formation in the prior-art two-color image forming apparatus.

FIG. 11 shows a change in photosensitive body potential with an elapse of time (shown by a solid line A in the figure) and a change in developing bias with an elapse of time (shown by a dashed line B in the figure) in a usual image forming process in a first development position (a development position of a first developing unit). A positive charge polarity of the photosensitive body 1 is shown, but the same is applied to a negative polarity. The photosensitive body 1 is charged to VD by the charge unit 2. Its charge is attenuated to VL when a printing portion S in an image width L (a length in a moving direction of the photosensitive body) receives the laser exposure 3. By applying VB1 for the developing bias, a positively charged toner T1 receives an electric force based on a potential difference Vc and adheres to an exposure portion to develop. A negatively charged carrier C receives an electric force directed to a non-exposure portion based on a potential difference Vb, but does not adhere to the non-exposure portion because Vb is small.

Figure 12:
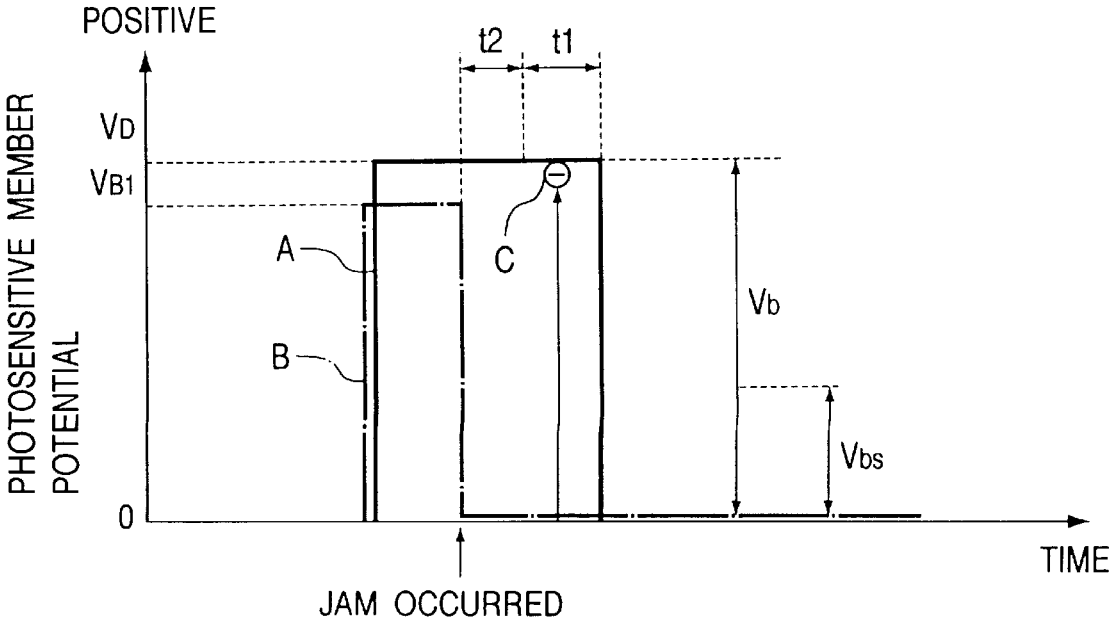
FIG. 12 is an explanatory view showing a mechanism of mixture of a carrier into a second developing unit in the prior-art two-color image forming apparatus.

By contrast, FIG. 12 shows changes in photosensitive body potential and developing bias in the first development position at the time of jam occurrence. Upon the jam occurrence, an output of the charge unit 2, the laser exposure 3 and the developing bias are turned off. After the jam occurrence, a region extending from the first development position on the photosensitive body to the charge unit 2 is uniformly charged and receives no exposure. Therefore, the first development position is passed with the potential being VD. In this case, since the developing bias is turned off, during a passing time (t1+t2) in the first development position, a potential difference Vb becomes larger than a potential difference Vbs when the carrier starts adhering. Then, the carrier adheres to the photosensitive body 1. As a result, the carrier mixes into the second developing unit.

The method of preventing the adhesion and mixture of the carrier according to the invention is described with reference to FIGS. 4 and 5.

Figure 3:
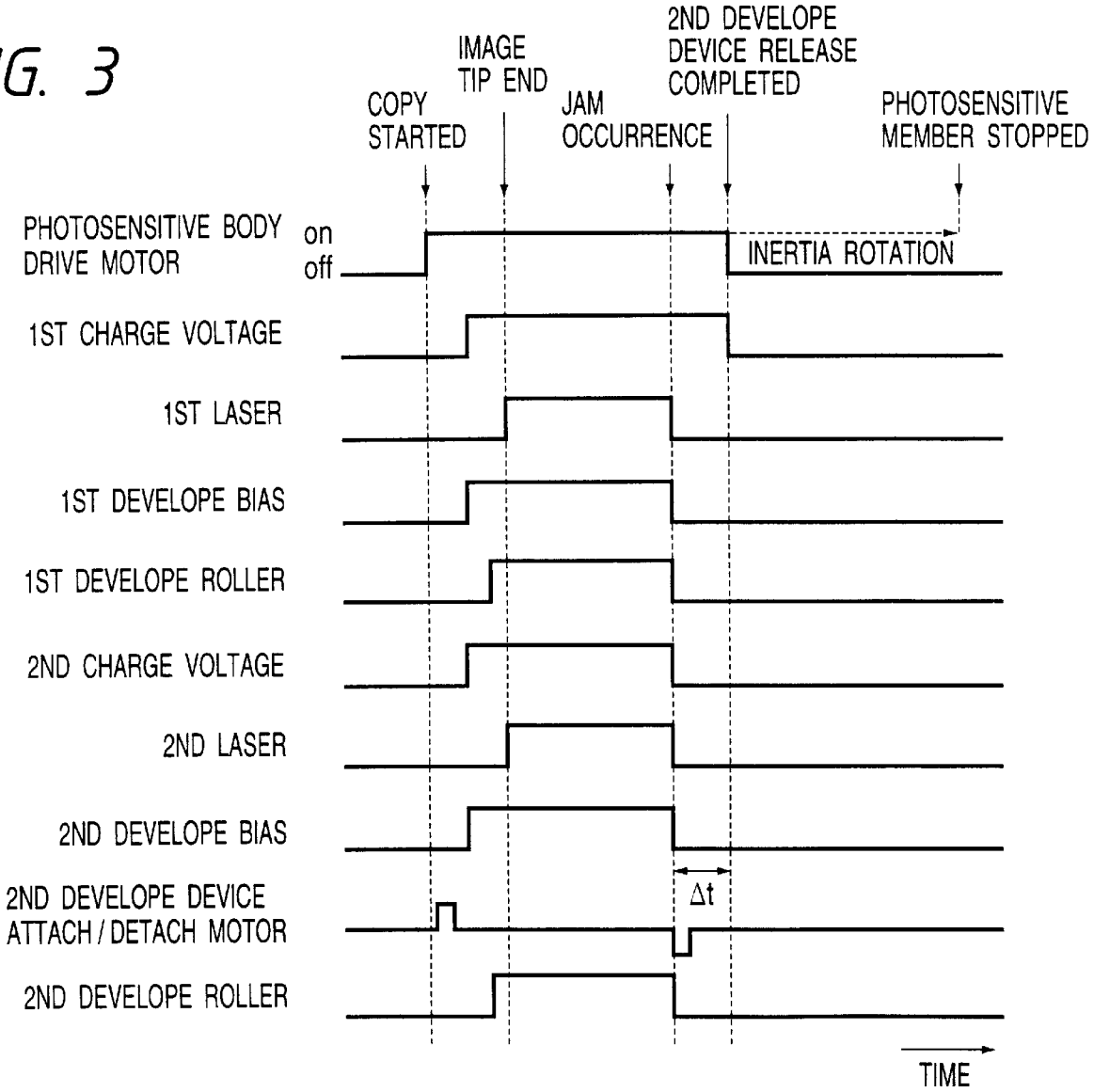
FIG. 3 is a timing chart of image formation in the embodiment of the invention.

FIG. 3 shows drive timings of respective units disposed around the photosensitive body for image formation. The driving of the units is shown based on the passing time of an image region on the rotating photosensitive body 1. For example, the first laser turns on when a portion corresponding to a tip end of an image on the photosensitive body 1 passes the first laser position (a position of the laser exposure 3). When the portion passes a second laser position (a position of the exposure 5) (at a time delayed by a predetermined time from the first laser position), the second laser turns on. From FIG. 3, such delay time is omitted (the same is applied to a timing chart described later).

On turning on an operation key for starting a copy operation, a photosensitive body drive motor turns on to start rotating the photosensitive body 1. Before the image tip end on the photosensitive body passes, the attaching/detaching motor of the second developing unit 7 turns on. The second developing unit 7 is moved to a development position by the moving means constituted of the attaching/detaching motor 106 and the cam 74 in FIG. 2. Subsequently, high-voltage outputs of the first and second charge units 2 and 5, a second developing bias and rotations of the first and second developing rollers successively turn on, thereby starting an image formation. During the image formation, if a jam occurs, the units other than the photosensitive body drive motor, the first charge high voltage and the first developing bias instantly turn off. Also, upon the jam occurrence, the second developing unit starts to be moved to a non-development position by the moving means. After a time Δt elapses after the second developing unit completes its movement, the photosensitive body drive motor, the first charge high-voltage and the first developing bias turn off. After the drive motor turns off, the photosensitive body inertially rotates and stops, thereby completing the copy operation after the jam occurrence.

Figure 4:
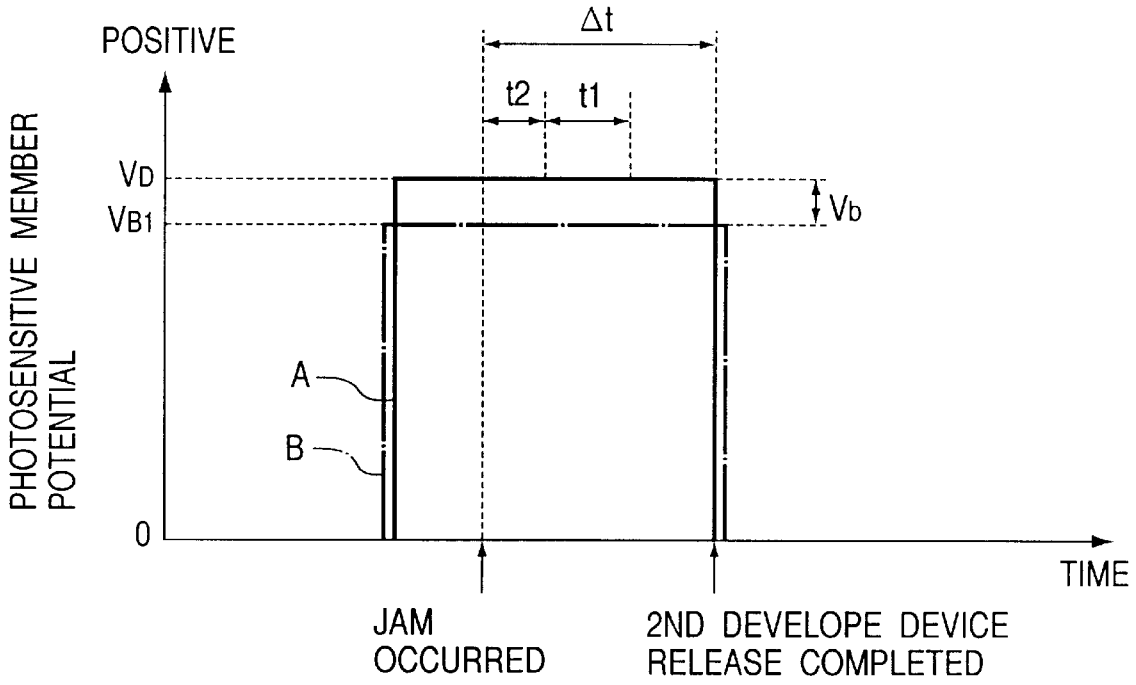
FIG. 4 shows changes in potential and developing bias during the image formation of FIG. 3.

FIG. 4 shows changes in photosensitive body potential and first developing bias with an elapse of time in the first development position at the aforementioned drive timings. Before the jam occurrence, the change is the same as aforementioned. After the jam occurrence, during Δt the first charge high voltage and the first developing bias continue turning on. Therefore, the potential and the developing bias remain at VD and VB1 as they are before the jam occurrence. Therefore, the potential difference Vb is unchanged. No carrier adheres to the photosensitive body. Therefore, no carrier mixes in the second developing unit.

After Δt, the second developing unit 7 has moved to the non-development position, the first charge and the developing bias turn off, and the potential and the developing bias are zero. In the non-development position, as shown in FIG. 2, the second developing roller 71 of the developing unit 7 is sufficiently distant from the photosensitive body 1. Even if the carrier adheres to the photosensitive body, a magnetic attraction of the magnetic roller 72 inside the developing roller 71 does not act on the carrier. Therefore, the carrier fails to adhere to and mix in the second developing roller 71. In the embodiment, in the non-development position, the second developing roller 71 is distant by 5 mm from a photosensitive body surface. A component perpendicular to the photosensitive body surface of a flux density exerted on the surface of the photosensitive body 1 by the magnetic roller 72 of the second developing roller 71 is 1000 gausses when the second developing unit 7 is in the development position, and reduced to its half or less 320 gausses when the second developing unit 7 moves to the non-development position.

In the embodiment, as aforementioned, the carrier is prevented from adhering to the photosensitive body and mixing in the second developing unit at the time of jam occurrence. A good two-color image can be obtained without uneven concentration of the second toner image or other image deterioration.

SECOND EMBODIMENT

In the first embodiment, during Δt after the jam occurrence, the high-voltage output of the first charge unit 2 is set the same as the output during the usual image formation. When the scorotron charge unit or the like is used as the first charge unit 2, ozone as a factor of deterioration of the photosensitive body 1 is generated in proportion to an output current, but a quantity of generated ozone can be suppressed by reducing the output current during Δt. In the second embodiment, the output current during Δt was reduced.

Figure 5:
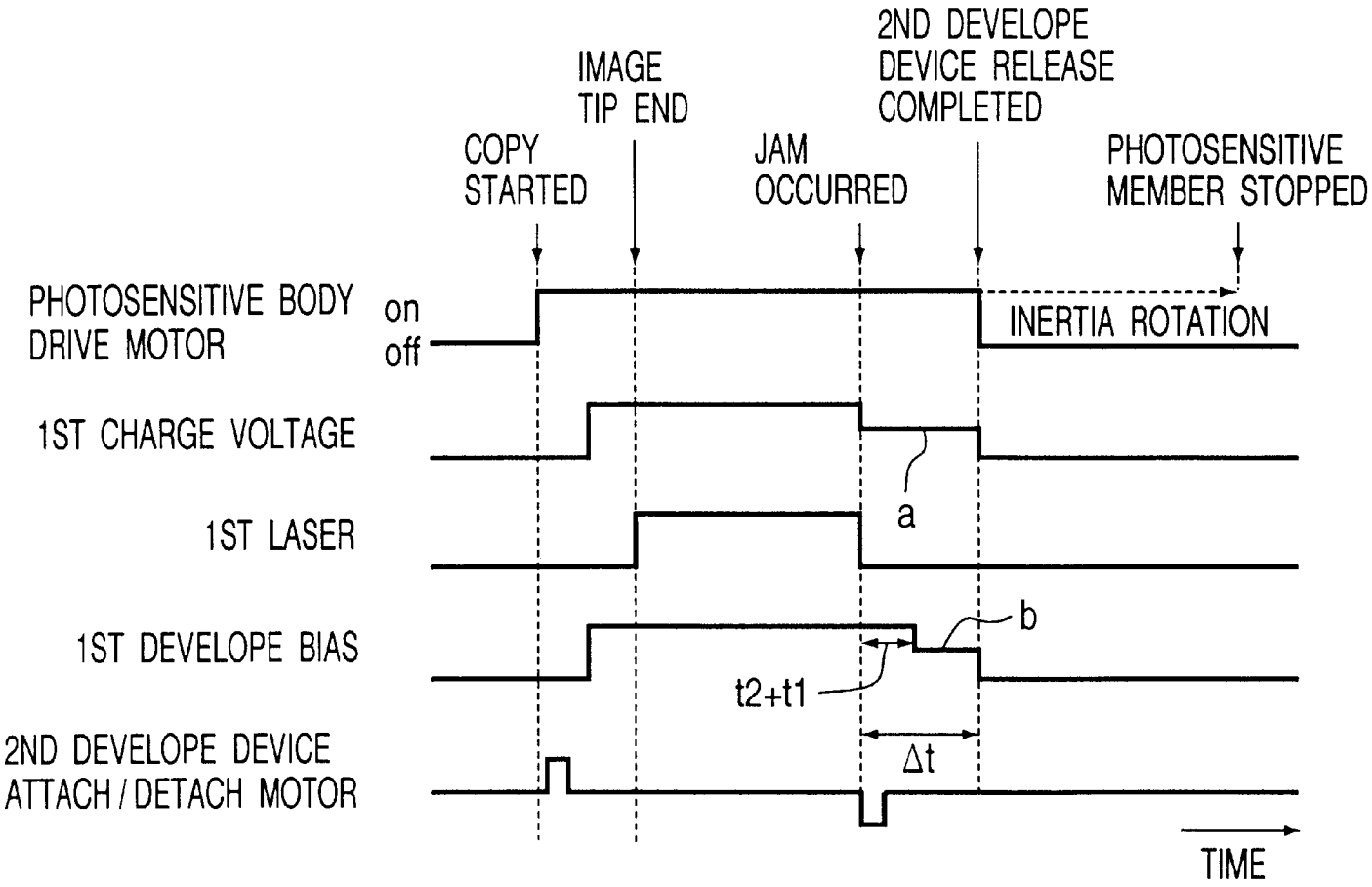
FIG. 5 is a timing chart of image formation according to another embodiment of the invention.

FIG. 5 shows an image formation timing when the output current is reduced in the embodiment. FIG. 5 mainly shows output timings of a first charge and a first developing bias. Drive timings of other image forming unit portions are the same as in FIG. 1. After the jam occurrence, an output of the first charge continues, but an output value is made smaller than before the jam occurrence (as shown by a in the figure). The first developing bias during a period (t1+t2) after jam occurrence is set the same output as before the jam occurrence, and is reduced on and after (t1+t2) (as shown by b in the figure). On and after Δt when the second developing unit completes its movement, both outputs are turned off.

Figure 6:
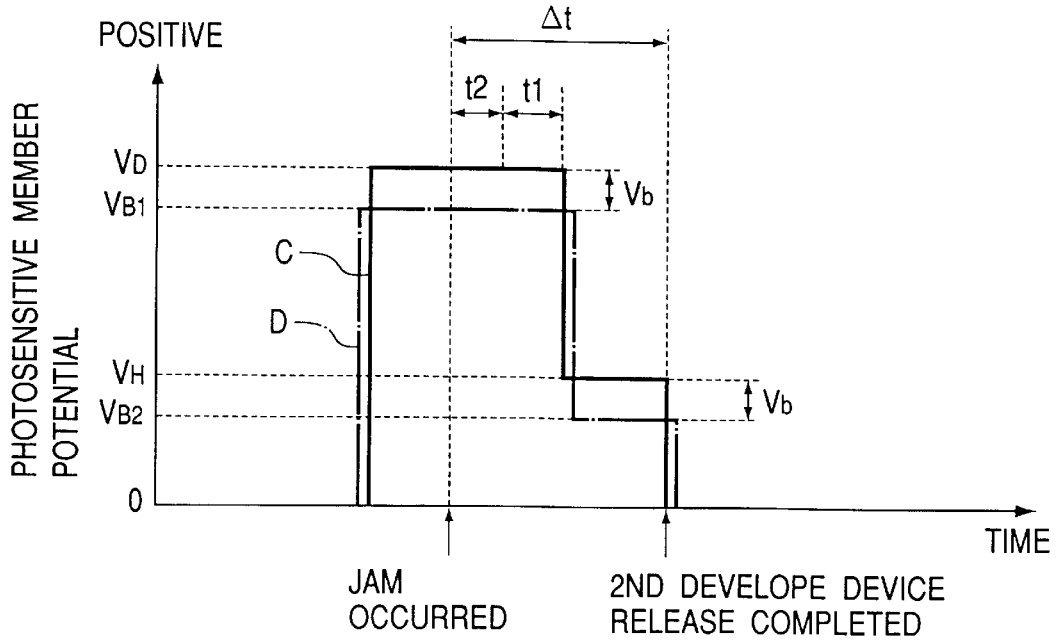
FIG. 6 shows changes in potential and developing bias during the image formation of FIG. 5.

FIG. 6 shows changes in potential (shown by a solid line C in FIG. 6) and first developing bias (shown by a dashed line D in FIG. 6) in a first development position. Before the jam occurrence and during (t1+t2) after the jam occurrence, the first charge output takes a value at the time of image formation. Therefore, the potential of the photosensitive body is VD, and for the developing bias the output VB1 at the time of image formation is applied. On and after (t1+t2) the potential lowers to VH because the first charge output is small, and the developing bias is changed to VB2 at which no carrier adheres. The value VB2 is set as $|VH-VB2|<Vbs$ (Vbs is the potential difference when the carrier starts adhering), in such a manner that $VD-VB1=VH-VB2$. The value VB2 is smaller than VH in order to prevent the toner in the first developing unit from excessively adhering to the photosensitive body and being consumed.

In the second embodiment, as aforementioned, the carrier is prevented from adhering to the photosensitive body and mixing in the second developing unit at the time of jam occurrence. In addition, the generation of ozone after the jam occurrence can be suppressed.

THIRD EMBODIMENT

Figure 7:
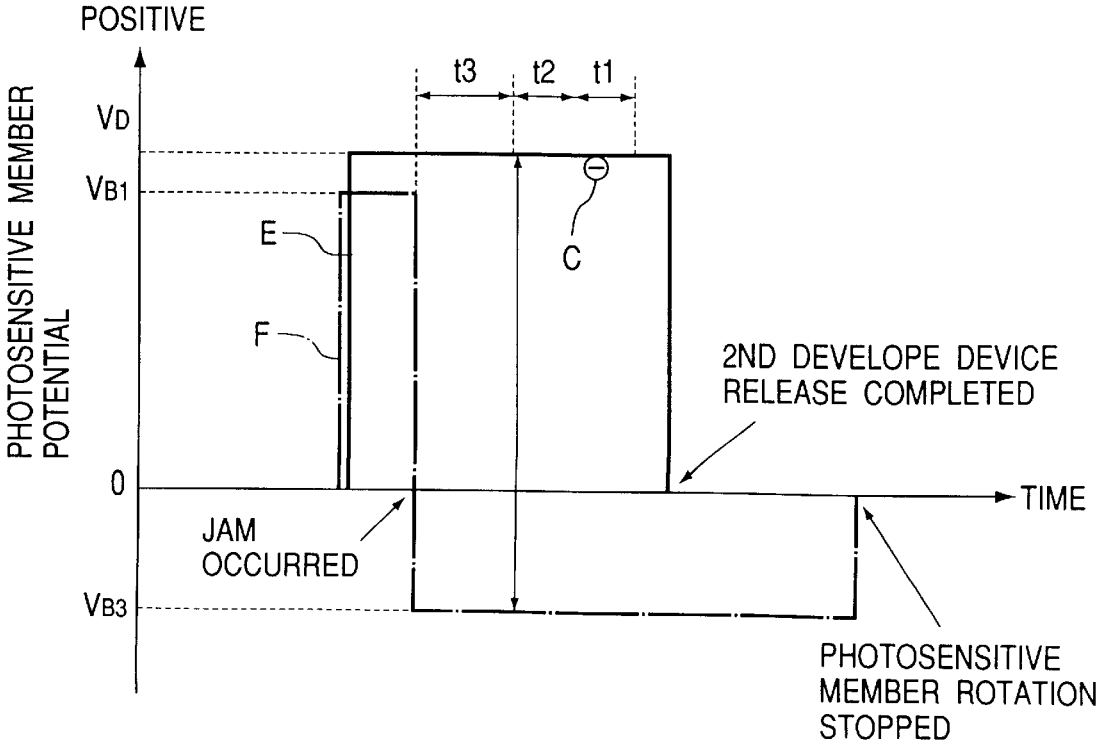
FIG. 7 shows changes in potential and developing bias during image formation according to further embodiment of the invention.

In the first embodiment, as shown in FIG. 2, when the second developing unit 7 is moved from the photosensitive body 1 to the non-development position, to firmly prevent the mixture of any carrier adhering to the photosensitive body 1, it is important to prevent the magnetic roller 72 in the developing roller 71 from exerting a magnetic attraction Fm to the carrier. However, because of a spatial restriction, in some case the developing roller 71 cannot be moved sufficiently apart from the photosensitive body 1. The third embodiment solves this problem. As shown in FIG. 7, by applying to the developing roller 71 a bias having the same polarity as a carrier charge polarity, the mixture of the carrier is prevented.

Figure 8:
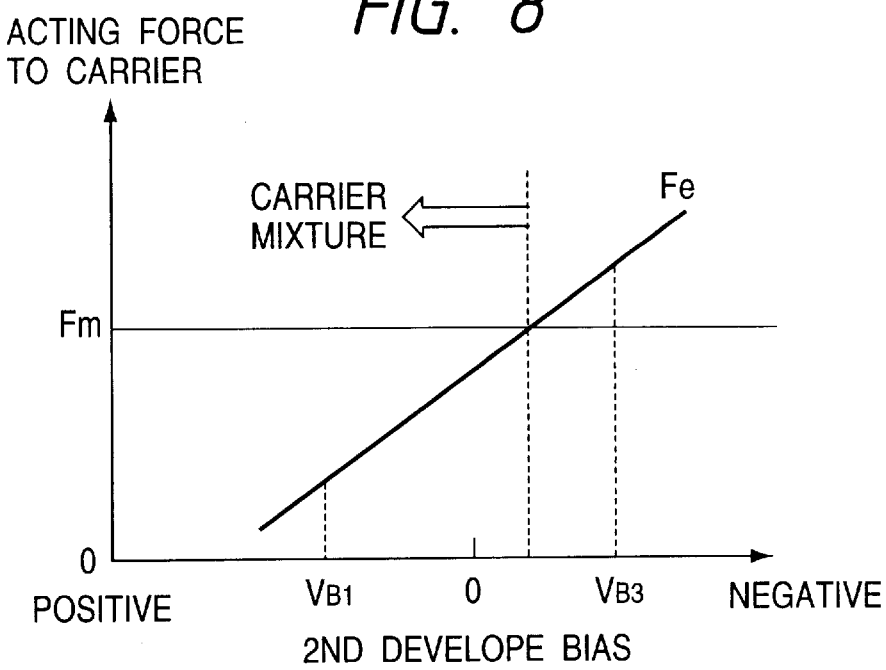
FIG. 8 is a diagrammatic representation showing a relationship between an attracting force acting on a carrier on a photosensitive body of FIG. 7 and a second developing bias.

FIG. 8 diagrammatically shows a relationship between an attraction acting to the carrier on the photosensitive body and a second developing bias. The magnetic attraction Fm which tries to attract the carrier to the developing roller 71 with the second developing unit 7 being apart is set constant. On the other hand, when a value of the second developing bias is increased on a polarity side the same as the carrier (negative polarity), an electric force Fe which tries to push the carrier onto the photosensitive body 1 is increased. When the developing bias is VB3, Fe>Fm. Then, no carrier mixes in the developing roller.

FIG. 7 shows changes in potential (F in the figure) and second developing bias (E in the figure) in the second development position. The change in potential is set in the same manner as in FIG. 1. On the jam occurrence, by changing the second developing bias from the bias VB1 for image formation to VB3, an electric force caused by a difference in potential between the potential VD and the bias VB3 acts on the carrier. Even if the developing roller is insufficiently apart, the mixture of carrier can be prevented. After the second developing unit finishes moving apart and the photosensitive body stops rotating, the bias is turned off.

FOURTH EMBODIMENT

Figure 9:
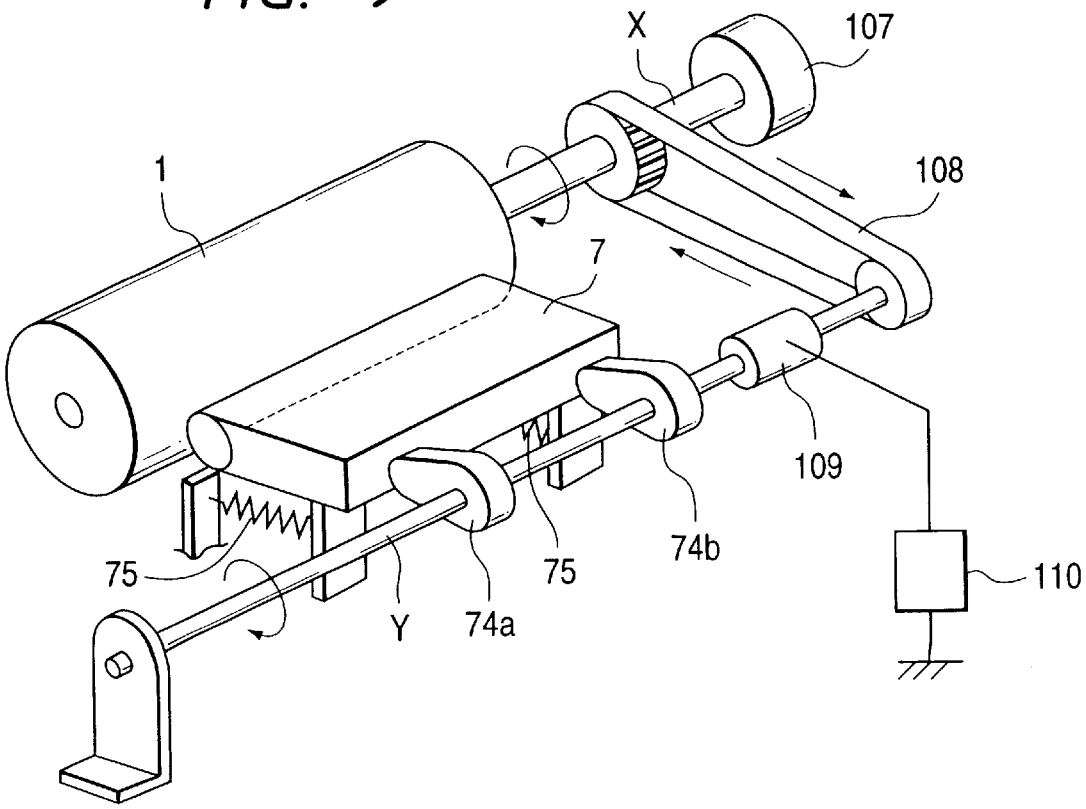
FIG. 9 is a perspective view showing a detaching means of a second developing unit at the time of power stoppage in further embodiment of the invention.

In a fourth embodiment, a case of trouble occurrence in power supply to the image forming apparatus is described. For example, when during image formation the power supply to the device is stopped by a power failure or the like, the first developing bias turns off. Therefore, in the same manner as the prior art (as shown in FIG. 12) the carrier adheres to the photosensitive body and mixes in the second developing unit. In this case, after the power stoppage, the photosensitive body inertially rotates, and the second developing unit may be moved sufficiently apart from the photosensitive body before a carrier adhesion region on the photosensitive body reaches the second development position (within time t3 in FIG. 1), so that the magnetic attraction of the second developing roller does not act on the carrier. A method of detaching the second developing unit after the power stoppage may be constituted, for example, as shown in FIG. 9. An axial rod X of the photosensitive body 1 is linked to an axial rod Y of an attaching/detaching cam 74 (74*a*, 74*b*) via a drive belt 108 in such a manner that the photosensitive body 1 and the cam 74 can be driven by a photosensitive body drive motor 107. An electromagnetic clutch 109 attached to the axial rod Y is detached when a power 110 turns on, and connected when the power turns off. When the power turns on, a drive force of the drive motor 107 of the photosensitive body 1 is not transmitted to the cam 74. The cam 74 as shown in the figure pushes the developing unit 7 toward the photosensitive body 1. When the power turns off, the motor 107 is stopped. A drive force produced by inertial rotation of the photosensitive body 1 is transmitted via the axial rod X, the belt 108 and the axial rod Y to rotate the cam 74. A biasing force of a spring 75 detaches the developing unit 7 from the photosensitive body 1.

Alternatively, by using a core rod of an electromagnetic coil as a pressing means for the developing unit, the developing unit may be pushed by the core rod during power supply, and detached by drawing the core rod when the power turns off.

As aforementioned, the invention provides a two-color image forming apparatus in which a first charging, exposure and developing process and a second charging, exposure and developing process continue to be performed while the photosensitive body rotates once, to form an overlapped toner image on the photosensitive body. The toner image is transferred on the transfer sheet with one transfer process, to form a two-color image. In this apparatus, when the image formation a transfer sheet jam or another trouble occurs, the second developing unit starts to be detached from the photosensitive body. While the developing unit is moving apart, the first charge and the first developing bias continue to turn on in the same manner as during the image formation. Thereby, the carrier contained in the first developing means is prevented from adhering to the photosensitive body. After the developing unit completes its movement, the first charge and the first developing bias are turned off. Therefore, the carrier can be prevented from mixing in the second developing means at the time of jam occurrence.

Also, when the power supply to the image forming apparatus is stopped and the carrier adheres to the photosensitive body, then the second developing means is detached sufficiently from the photosensitive body before the photosensitive body surface with the carrier attached thereto reaches the second development position, thereby preventing the mixture of the carrier. Therefore, the second developing means can be prevented from deteriorating because of the carrier mixture.

What is claimed is:

1. An image forming apparatus comprising:

a rotatable image bearing member;

charging means for charging said image bearing member;

first developing means for developing an electrostatic latent image formed on said image bearing member with two-component developer including magnetic carrier and nonmagnetic toner;

second developing means disposed downstream of said first developing means in a rotational direction of said image bearing member for developing with magnetic toner, said second developing means including a magnetic member producing a magnetic force which acts on said magnetic toner, said magnetic member being moveable between a development operative position in which said second developing means performs a development operation with respect to said image bearing member and a development inoperative position in which said second developing means does not perform the development operation with respect to said image bearing member;

transferring means for collectively transferring images of said nonmagnetic toner and said magnetic toner formed on said image bearing member onto a transfer material; and detecting means for detecting an error of said image forming apparatus, wherein between a time when the error is detected by said detecting means and a time when a rotation of said image bearing member is stopped, there is a time period during which a voltage for preventing said magnetic carrier from adhering from said first developing means to said image bearing member is applied to first developing means and a time period during which said magnetic member is moved from said development operative position to said development inoperative position.

2. An image forming apparatus according to claim 1, wherein said detecting means detects a jam of said transfer material.

3. An image forming apparatus according to claim 1, wherein between the time when the error is detected by said detecting means and the time when the rotation of said image bearing member is stopped, there is a time period during which a voltage having a same polarity as a charged polarity of said magnetic carrier is applied to said second developing means.

4. An image forming apparatus according to claim 1, wherein between the time when the error is detected by said detecting means and the time when the rotation of said image bearing member is stopped, said first developing means is immovable with respect to said image bearing member.

5. An image forming apparatus according to claim 1, wherein after a predetermined time period has passed after the time when the error is detected by said detecting means, a voltage applied to said charging means and the voltage applied to said first developing means are turned off.

6. An image forming apparatus according to claim 1, wherein between the time when the error is detected by said detecting means and the time when the rotation of said image bearing member is stopped, the voltage applied to said charging means and the voltage applied to said first developing means are turned off.

7. An image forming apparatus according to claim 1, wherein between the time when the error is detected by said detecting means and the time when the rotation of said image bearing member is stopped, there is a time period during which a voltage applied to said charging means and the voltage applied to said first developing means for preventing said magnetic carrier from adhering from said first developing means to said image bearing member are made smaller than voltages applied for image formation.

* * * * *